US009200635B2

(12) United States Patent
Blackburn

(10) Patent No.: US 9,200,635 B2
(45) Date of Patent: Dec. 1, 2015

(54) IMPELLER AND REGENERATIVE BLOWER

(75) Inventor: Christopher Lee Blackburn, St. Joseph, MI (US)

(73) Assignee: Gast Manufacturing, Inc. A Unit of IDEX Corporation, Benton Harbor, MI (US)

( * ) Notice: Subject to any disclaimer, the term of this patent is extended or adjusted under 35 U.S.C. 154(b) by 910 days.

(21) Appl. No.: 13/440,503

(22) Filed: Apr. 5, 2012

(65) Prior Publication Data

US 2013/0266434 A1 Oct. 10, 2013

(51) Int. Cl.
*F04D 23/00* (2006.01)
*F04D 29/30* (2006.01)

(52) U.S. Cl.
CPC ..... *F04D 23/008* (2013.01); *F04D 29/30* (2013.01)

(58) Field of Classification Search
CPC ..... F04D 23/008; F04D 29/30
See application file for complete search history.

(56) References Cited

U.S. PATENT DOCUMENTS

| | | | | |
|---|---|---|---|---|
| 5,407,318 | A | 4/1995 | Ito et al. | |
| 5,513,950 | A * | 5/1996 | Yu | 415/55.1 |
| 5,527,149 | A | 6/1996 | Moss et al. | |
| 5,762,469 | A | 6/1998 | Yu | |
| 6,113,363 | A | 9/2000 | Talaski | |
| 6,296,439 | B1 | 10/2001 | Yu et al. | |
| 6,422,808 | B1 | 7/2002 | Moss et al. | |
| 6,425,733 | B1 | 7/2002 | Ross | |
| 6,439,833 | B1 | 8/2002 | Pickelman et al. | |
| 6,454,520 | B1 | 9/2002 | Pickelman et al. | |
| 6,454,522 | B2 | 9/2002 | Sakamoto et al. | |
| 6,641,361 | B2 | 11/2003 | Yu | |
| 6,890,144 | B2 | 5/2005 | Yu et al. | |
| 6,974,302 | B2 | 12/2005 | Motojima et al. | |
| 6,984,099 | B2 | 1/2006 | Yu et al. | |
| 7,033,137 | B2 * | 4/2006 | Shufeldt | 415/119 |

FOREIGN PATENT DOCUMENTS

| | | |
|---|---|---|
| EP | 0 384 935 | 9/1990 |
| JP | 8094608 | 4/1996 |
| JP | 9285773 | 11/1997 |

* cited by examiner

*Primary Examiner* — Nathaniel Wiehe
*Assistant Examiner* — Jeffrey A Brownson
(74) *Attorney, Agent, or Firm* — Miller, Matthias & Hull LLP

(57) ABSTRACT

A regenerative blower is disclosed with a rotating impeller that includes a hub that includes a main body and a tapered outer periphery or volute that extends around the main body of the hub. The volute has a wide base that extends to a tapered volute tip. A plurality of vanes are spaced apart along the main body of the hub and intersect the volute. Each vane has a base coupled to or integral with the main body of the hub and a distal end extending radially away from the hub. Each vane has a downstream side and an upstream side. The downstream sides are concave and the upstream sides are convex. Each vane may also include a pair of side edges that are beveled inwardly towards the volute as the side edges extend from the downstream side of the vane to the upstream side of the vane.

25 Claims, 11 Drawing Sheets

IMPELLER AND REGENERATIVE BLOWER

TECHNICAL FIELD

This disclosure relates generally to regenerative blowers and designs for improving the performance of regenerative blowers.

BACKGROUND

In general, conventional blowers can be of a multi-stage or a positive air-displacement type. Conventional blowers enable chemical processing plants and refineries to handle or separate hazardous and corrosive gases, such as vent header off-gassing, spot source, centrifuge venting, or scrubber applications. However, mounting industry pressures to reduce energy and maintenance costs, simplify processes, and improve productivity have led many users of conventional blowers to look for alternatives. Further, because of energy consumption and demanding maintenance requirements, conventional blowers are expensive to operate.

In contrast, regenerative blowers can serve as a practical, efficient, and industry-friendly alternative to help keep costs down and output high. The advantages of regenerative blowers include energy efficiency, low maintenance, and high reliability. As explained below, regenerative blowers also supply clean air and eliminate the need for expensive outlet filters and dryers or special water and oil traps.

In operation, regenerative blowers draw air or other gases into the blower unit by impeller vanes passing an inlet port. The impeller vanes are spaced apart around the periphery of the impeller. Two adjacent impeller vanes capture air and gas from the inlet and centrifugal forces accelerate the air in a radially outward and forward direction. The air is rotated or "regenerated," by the blower's annular-shaped housing and recapturing of the rotating air between a pair of following vanes, where it is again rotated or "regenerated," as it enters the space between the following pair of vanes. The successive regenerations imposed on the air and gas impart more pressure to the air and gas.

When the air reaches a "stripper section" at the outlet of the regenerative blower, it is "stripped" from the impeller and diverted out the blower. The stripper section is located between the inlet and the outlet where the annulus is reduced in size to fit closely to the sides and tips of the impeller vanes. As a result, pressures generated by the spinning, non-contacting, oil-free impeller are equal to those obtained by many larger multi-stage or positive displacement blowers.

In summary, regenerative blowers are energy efficient, require little maintenance and are reliable. Regenerative blowers supply clean air and are free of oil, excess moisture, and other compressor-induced contaminants. Regenerative blowers also eliminate any need for expensive, high-maintenance outlet filters and dryers or special water and oil traps. Modern surface treatments of the impeller and internal parts give regenerative blowers the capability to withstand the corrosive, hazardous, and harsh conditions presented by the chemical processing industry.

However, current impeller geometries are relatively inefficient at higher pressure and vacuum duties, as evidenced by sudden drops in air flow and subsequent increases in exhaust temperatures. The typical vane shape of currently available impellers consists of two or three forward bending segments that extend radially outward from the impeller hub. The width of the vane is constant. The central impeller includes a hub having an outer periphery or "volute" that is used to transition the air from axially entering the impeller between two vanes to radially exiting the impeller outer diameter. The volute may be a straight wall that exends radially outward from the hub and that is intersected by the vanes (see, e.g., U.S. Pat. No. 7,033,137, FIG. 2) or the sidewalls may be convex (see, e.g., U.S. Pat. No. 7,033,137, FIG. 4).

There is a need for improved impeller designs, including improved vanes and volute designs that will make regenerative blowers more efficient and therefore more attractive for a broader range of applications.

SUMMARY OF THE DISCLOSURE

In satisfaction of the aforenoted needs, an improved regenerative blower is disclosed. The regenerative blower includes a casing that includes an inlet and an outlet. The casing defines a chamber. An impeller is rotatably received in the chamber about an axis of rotation. The impeller includes a hub that includes a main body and a outer periphery or volute, which extends around the main body of the hub. The volute has a wide base coupled to or integral with the main body that extends to a narrow centrally located volute tip that may or may not extend radially outward in a plane to form a web-like structure at the distal end of the tip. A plurality of vanes are spaced apart along the volute. Each vane has a base coupled to the hub and a distal end extending radially away from the hub. Each vane also has a downstream side and an upstream side. The downstream side is concave; the upstream side is convex. Each vane includes a pair of side edges that connect the downstream side of the vane to the upstream side of the vane. The side edges each comprise a first portion disposed along the downstream side of the vane and that are substantially perpendicular to the downstream side of the vane. The second portions of the side edges are beveled inwardly towards the volute as the edges extend from the first portions to the upstream side of the vane. The distal ends of the vanes are thinner than the bases of the vanes.

An impeller is also disclosed. The impeller includes a hub having an axis of rotation about which the impeller rotates. The hub includes an outer periphery or volute that extends around the main body of the hub. The volute has a wide base coupled to or integral with the main body that extends to a narrow centrally located volute tip that may or may not include a web as described above. A plurality of vanes are spaced along the outer periphery of the main body of the hub and intersect the volute. Each vane has a base coupled to the outer periphery of the main body of the hub and the volute that extends radially away from the main body of the hub. Each vane has a downstream side and an upstream side. The downstream side is concave; the upstream side is convex.

In any one or more of the embodiments described above, one or more downstream vane side edges comprises one continuous smooth concave curvature.

In any one or more of the embodiments described above, one or more upstream vane edges comprises one continuous smooth convex curvature.

In any one or more of the embodiments described above, one or more downstream vane side edges comprises a plurality of segments that approximate one continuous smooth concave curvature.

In any one or more of the embodiments described above, one or more upstream vane side edges comprises a plurality of segments to approximate one continuous smooth convex curvature.

In any one or more of the embodiments described above, one or more downstream vane side edges comprises a combination of one or more curves and one or more segments to approximate one continuous smooth concave curvature.

In any one or more of the embodiments described above, one or more upstream vane side edges comprises a combination of one or more curves and one or more segments to approximate one continuous smooth convex curvature.

In any one or more of the embodiments described above, the volute comprises opposing side walls that are tapered between the volute base and the volute tip.

In any one or more of the embodiments described above, the volute comprises opposing side walls that are tapered between the volute base and the volute tip that may or may not include a radially outwardly extending web.

In any one or more of the embodiments described above, the volute comprises opposing side walls that are concave as they extend between the volute base and the volute tip.

In any one or more of the embodiments described above, the volute comprises opposing side walls that are concave as they extend between the volute base and the volute tip that may or may not include a radially outwardly extending web.

In any one or more of the embodiments described above, the distal ends of the vanes are tapered.

In any one or more of the embodiments described above, the outermost periphery of the hub may have a volute tip radius $R_{VoluteTip}$ defined by the relationship $(D_{Major}-D_{Mmor})\times X_2$ where $X_2$ ranges from about 0.01 to about 0.015 inches and where $D_{Major}$ is the diameter at the distal ends of the vanes or the outermost periphery of the impeller and $D_{Minor}$ is the diameter of the main body of the hub at the base of the volute.

In any one or more of the embodiments described above, the outermost periphery of the hub may have a volute web thickness $T_{VoluteWeb}$ defined by the relationship $(D_{Major}-D_{Minor})\times X_4$ where $X_4$ ranges from about 0.02 to about 0.03 inches and where $D_{Major}$ the diameter at the distal ends of the vanes or the outermost periphery of the major impeller and $D_{Minor}$ is the diameter of the main body of the hub at the base of the volute.

In any one or more of the embodiments described above, the impeller has a thickness or width at the vanes $W_{Impeller}$ defined by the relationship $(D_{Major}-D_{Minor})/2\times X_3$, wherein $X_3$ ranges from about 1.0 to about 1.25, where $D_{Major}$ is the diameter of the impeller at the distal ends of the vanes and $D_{Minor}$ is the diameter of the main body of the hub at the base of the volute.

In any one or more of the embodiments described above, the first portion of the side edges of the vanes have a width $W_{VaneEdge}$ defined by the relationship $(D_{Major}-D_{Minor})\times X_2$, wherein $X_2$ ranges from about 0.01 to about 0.015.

In any one or more of the embodiments described above, the first portion of the side edges of the vanes have an edge height $H_{VaneEdge}$ defined by the relationship $W_{VaneEdge}/Y$, wherein Y ranges from about 1.5 to about 3.

In any one or more of the embodiments described above, the vanes have a thickness $T_{Base}$ at the base of the volute. $T_{Base}$ is defined by the relationship $(D_{Major}-D_{Minor})/(4\times\pi)$ where $D_{Major}$ is the diameter of the impeller at the distal ends of the vanes, and $D_{Minor}$ is the diameter of the main body of the hub at the base of the volute.

In any one or more of the embodiments described above, the vanes have a thickness $T_{Tip}$ at the distal end of vanes defined by the relationship $T_{Base}\times X_1$, wherein $X_1$ ranges from about 0.65 to about 0.75.

In any one or more of the embodiments described above, the number of vanes $N_{Vanes}$ is defined by the relationship $(D_{Minor}\times\pi)/(T_{Base}+T_{Tip})$, wherein $D_{Minor}$ is the diameter of the main body of the hub at the base of the volute, $T_{Base}$ is the thickness of vanes at the base of the volute and $T_{Tip}$ is defined by the relationship $(T_{Base}\times X_1)$ wherein $X_1$ ranges from about 0.65 to about 0.75.

In any one or more of the embodiments described above, downstream side of the vanes have a concave leading radius $R_{Leading}$ defined by the relationship $[D_{Major}^2+D_{Minor}^2)/(N_{Vanes})]^{1/2}$, wherein $D_{Minor}$ is the diameter of the hub at the base of the volute, $D_{Major}$ is the diameter of the impeller at the distal ends of the vanes and $N_{Vanes}$ is the number of vanes.

In any one or more of the embodiments described above, a radius $R_{BaseThickness}$ is geometrically defined by a center point that is coincident with the center point of $R_{Leading}$ and the vane trailing point on $D_{Minor}$ at $T_{Base}$.

In any one or more of the embodiments described above, upstream side of the vanes have a convex trailing radius $R_{Traing}$ geometrically defined by the vane trailing point on $D_{Minor}$ at $T_{Base}$, the vane trailing point on $D_{Major}$ at $T_{Tip}$, and its tangency or near tangency to $R_{BaseThickness}$.

In any one or more of the embodiments described above, the outermost periphery of the hub has a cross-sectional diameter $D_{VoluteTip}$ defined by the relationship $(D_{Major}+D_{Minor})/2+(2\times R_{VoluteTip})$.

In any one or more of the embodiments described above, the outermost periphery of the hub has a cross-sectional diameter $D_{VoluteWeb}$, which is greater than $D_{Minor}$ and less than or equal to $D_{Major}$.

Other features and advantages will be discussed below in connection with the accompanying drawings.

DETAILED DESCRIPTION

Figure 1:
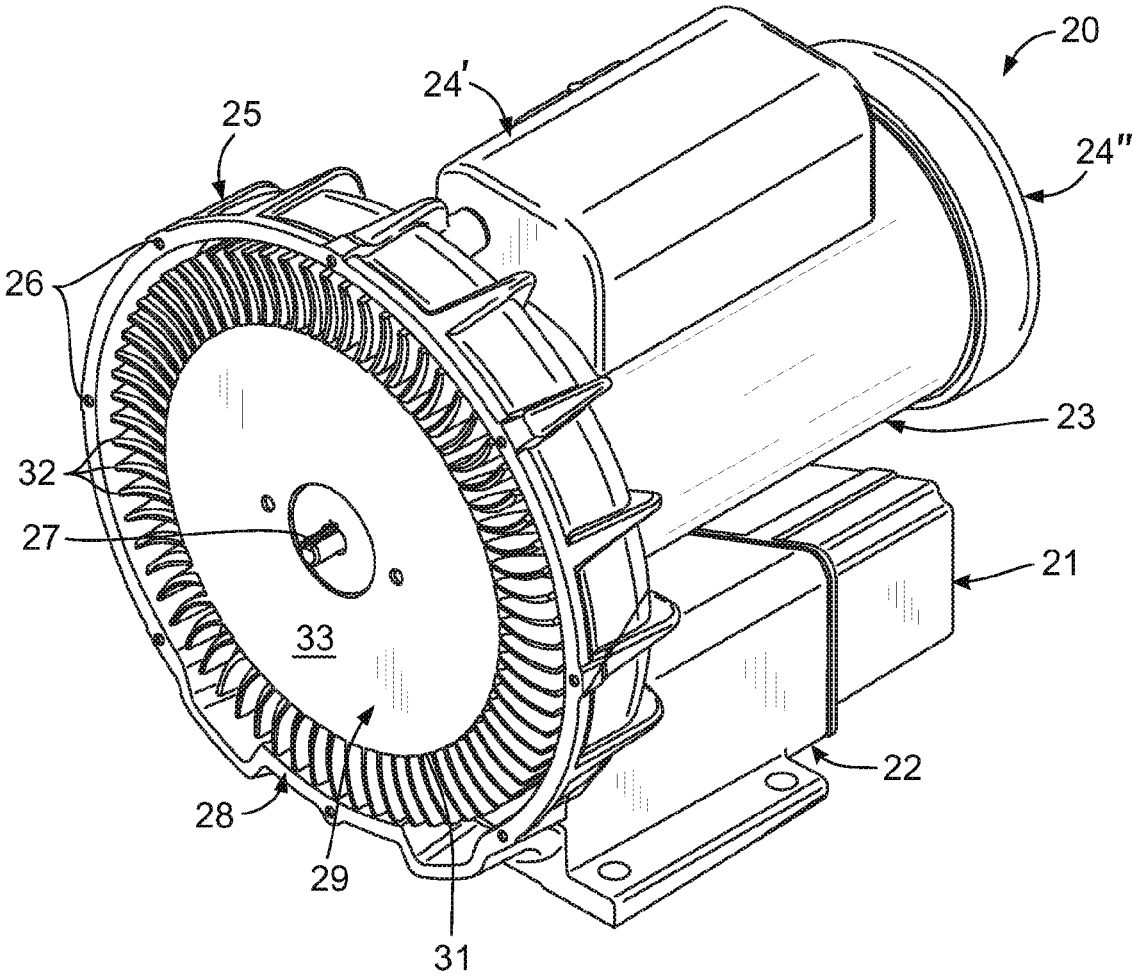
FIG. 1 is a perspective view of a regenerative blower made in accordance with this disclosure.
Figure 1A:
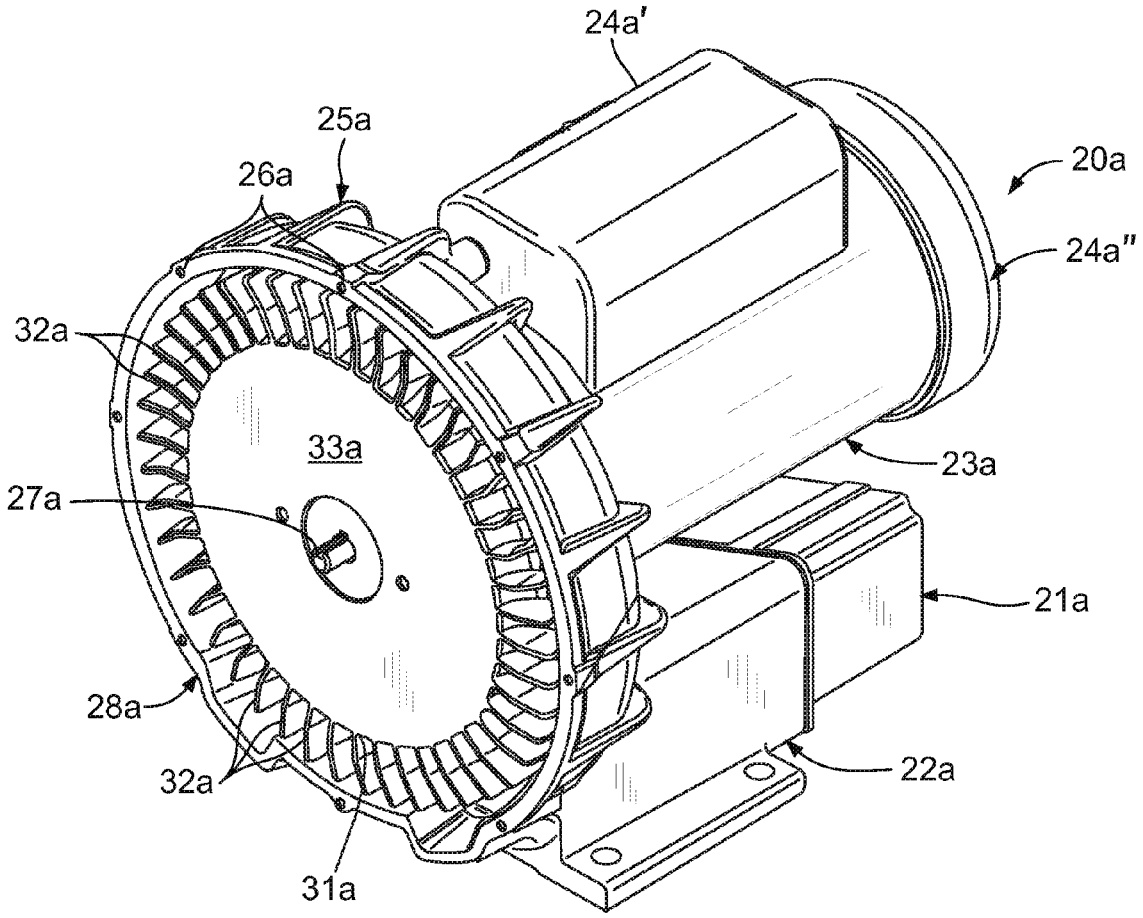
FIG. 1A (Prior Art)
FIG. 1A is a perspective view of a conventional regenerative blower.

FIG. 1 is a perspective view of a regenerative blower 20 made in accordance with this disclosure. The regenerative blower 20 includes an inlet and an outlet, neither of which are shown in FIG. 1. The inlet and outlet both pass through the rear manifold 21 which is coupled to the main bracket 22, which is disposed beneath the motor housing 23. In addition to the motor housing 23, a motor cover 24' and a motor capacitor/electrical box 24" are shown. The motor housing 23 is also coupled to an impeller housing 25. The impeller housing 25 includes a cover (not shown) secured to the impeller housing 25 via a plurality of fasteners, such as screws (not shown) that connect via the threaded holes 26.

Figure 2:
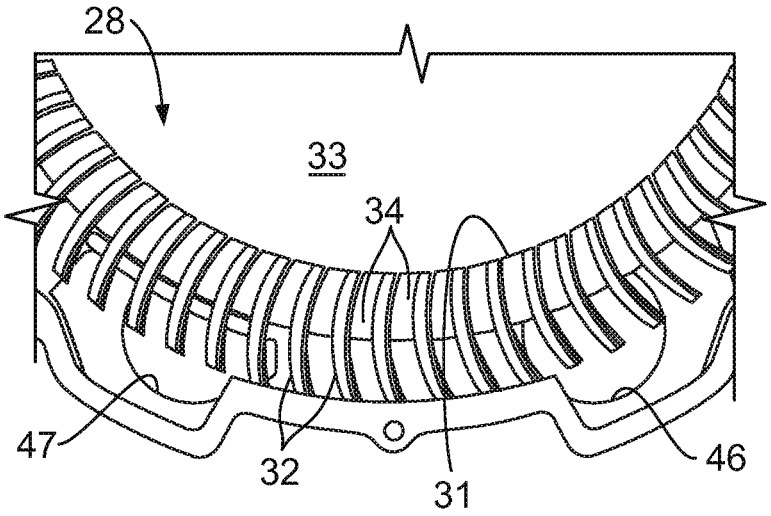
FIG. 2 is a partial front view of the regenerative blower shown in FIG. 1, particularly illustrating a portion of the impeller and casing.
Figure 2A:
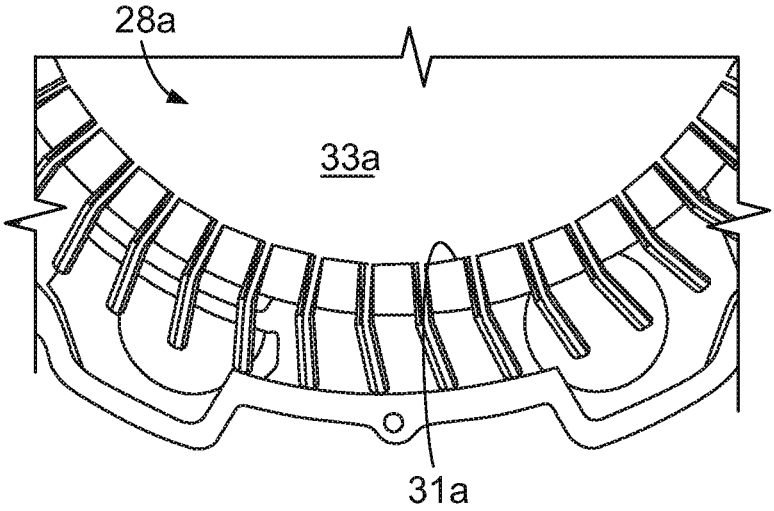
FIG. 2A (Prior Art)
FIG. 2A is a partial front view of a conventional regenerative blower shown in FIG. 1A.
Figure 3:
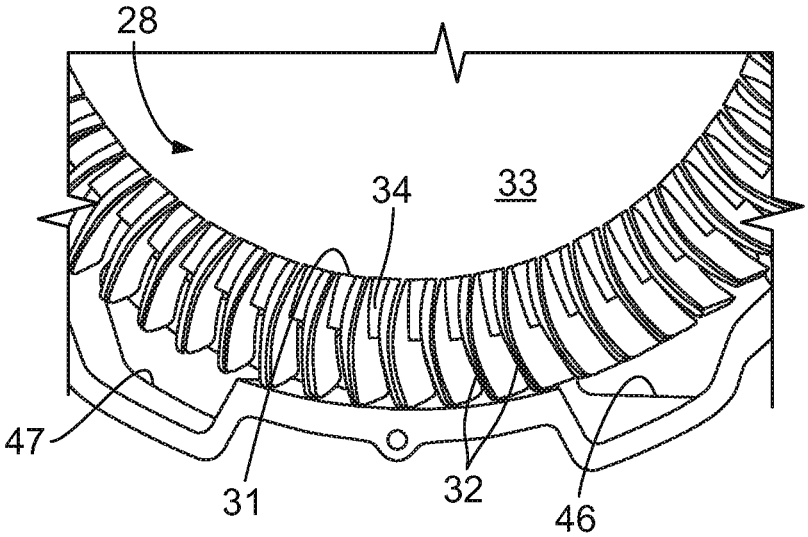
FIG. 3 is a partial rear view of the regenerative blower shown in FIG. 1, particularly illustrating a portion of the impeller and casing.
Figure 3A:
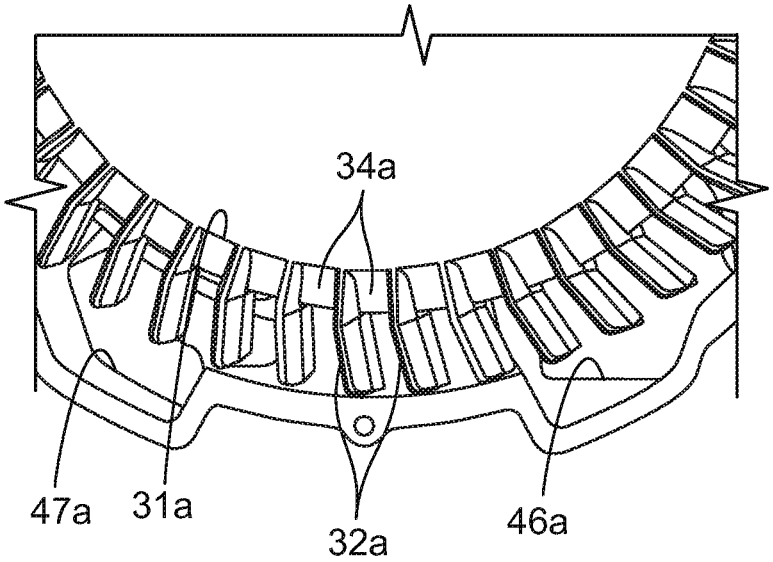
FIG. 3A (Prior Art)
FIG. 3A is a partial rear view of the conventional regenerative blower shown in FIG. 1A.

Referring to FIGS. 1-3, the motor (not shown) is coupled to a drive shaft 27 which, in turn, is coupled to the impeller 28. The impeller 28 includes a central hub 29 that includes a main body 33 having an outer periphery 31 that is coupled to or integral with a volute 34. The outer periphery 31 and volute 34 are coupled to a plurality of curved vanes 32. The vanes 32 are spaced apart around the periphery 31 of the main body 33 and the hub 29 with gaps disposed between each vane 32.

Figure 4:
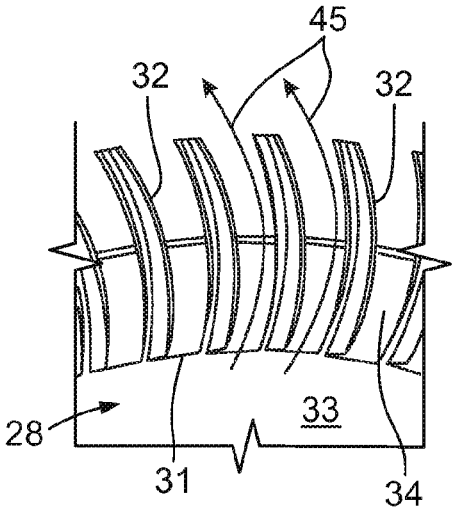
FIG. 4 is a partial plan view of the impeller illustrated in FIGS. 1-3.
Figure 5:
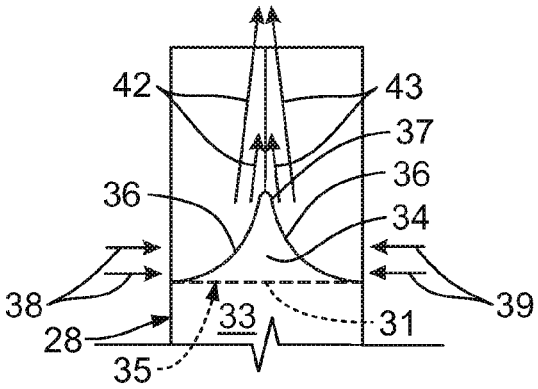
FIG. 5 is a side sectional view of the volute of the hub of a disclosed impeller.

Referring to FIG. 4, the hub 29 of the impeller 28 includes or is coupled to a volute 34 that features a wide base 35 that is connected to the main body 33 of the impeller 28 at the outer periphery 31 of the main body 33 as shown in FIG. 5. The wide base 35 of the volute 34 leads to a pair of curved side walls 36 that form an apex or volute tip 37. The volute tip 37 is rounded and includes a radius, $R_{VoluteTip}$, which will be defined below.

The purpose of the volute 34 of the impeller 28 is to channel incoming air as indicated by the arrows 38, 39 (FIG. 5) from a horizontal direction towards a radially outward direction as indicated by the arrows 42, 43. The radially outward direction of the air flow as indicated by the arrows 42, 43, in combination with the rotation of the impeller 28 about the axis of the drive shaft 27 causes the incoming air flow to flow in the direction of the arrows 45 shown in FIG. 4.

In other words, incoming air proceeds through the manifold 21 (FIG. 1) and towards the rotating impeller 28. Inlet and outlet ports are shown at 46, 47 in FIGS. 2 and 3. The incoming air is drawn in towards the rotating impeller vanes 32 where the air engages the volute 34. As air engages the volute 34, the centrifugal forces created by the rotating impeller 28 forces the air in a radially outward direction as indicated by the arrows 42, 43 and 45 as shown in FIGS. 4-5.

Figure 4A:
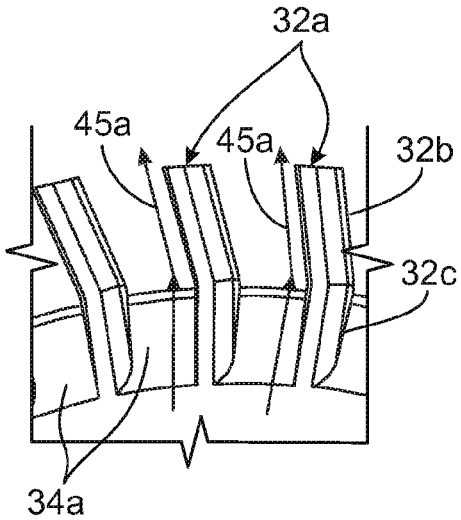
FIG. 4A (Prior Art)
FIG. 4A is a partial plan view of the conventional impeller illustrated in FIGS. 1A-3A.

A comparison of the performance of the disclosed regenerative blower 20 with a currently available regenerative blower 20*a* is provided by FIGS. 1-5 and FIGS. 1A-FIGS. 5A. The same reference numerals, followed by the suffix "a" are used to identify the parts of the prior art regenerative blower 20*a*. Turning to FIG. 1, the designs are similar, except the reader will note that the vanes 32*a* include two flat sections 32*b*, 32*c* as best illustrated in FIG. 4A. Further, while the regenerative blower 20*a* includes a volute 34*a*, from FIG. 5A, one can see that the volute 34*a* includes flatter side walls 36*a* and volute tip 37*a* having a radius that is substantially greater than the radius than the apex 34*a* shown in FIG. 5. As a result, incoming air indicated by the arrows 38*a*, 39*a* is directed radially outward, but at angles whereby the flow of the air intersects at a relatively shallow area near the volute tip 37*a* as indicated by the arrows 42*a*, 43*a* in FIG. 5A.

The regenerative blower 20 illustrated in FIGS. 1-5 provides increased velocity of the regenerative air flow in the blower 20 by reducing restrictions and turbulence which allow higher air flow through the blower 20 and at higher pressures and vacuum duties. Further, the blower 20 of FIGS. 1-5 reduces blower exhaust temperatures. These and other flow improvements are made by changing the shape of vanes 32 versus the prior art vanes 32*a*, the shape of the volute 34, versus the prior art volute 34*a*, as well as the number of vanes 32, versus the number of vanes 32*a* in the prior art blower 20*a*.

Figure 5A:
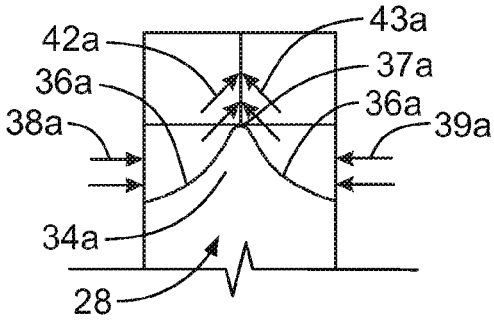
FIG. 5A (Prior Art)
FIG. 5A is a side sectional view of the volute of the hub of a conventional impeller.

Specifically, referring to FIGS. 4A and 5A, the direction of air flow entering the gap between the vanes 32*a* and at the base of the volute 34*a* is changed by the sharp bends in the vane between the flat sections 32*b* and 32*c*. The sharp bends in the vanes 32*a* result in air velocity loss and heat generation as the air is accelerated in a radially outward direction as indicated by the arrows 45*a*. In FIG. 5A, the regenerated air flows from opposite sides of the impeller 28*a* intersect above the volute tip 37*a* at relatively shallow angles as shown in FIG. 5A, which results in turbulence, air velocity loss and heat generation.

Turning to FIGS. 4 and 5, the disclosed impeller vanes 32 are curved or arcuate in shape. The segmented bent vanes 32*a* of FIG. 4A have been replaced with vanes 32 having a continuous curve. In FIG. 5, the volute 34 is changed so that the regenerated air flows from opposite sides of the impeller as indicated by the lines 38, 39 and the air intersects above the volute tip 37 at near tangent angles and/or the air flows intersect at very shallow angles, i.e. near parallel, as the air flow is accelerated radially outward as indicated by the arrows 35 in FIG. 4. In addition, the number of the vanes 32 has been increased along with a tapering or beveling of the edges 54 of the vanes 32, which will be explained in greater detail in connection with FIGS. 6-7.

Figure 6:
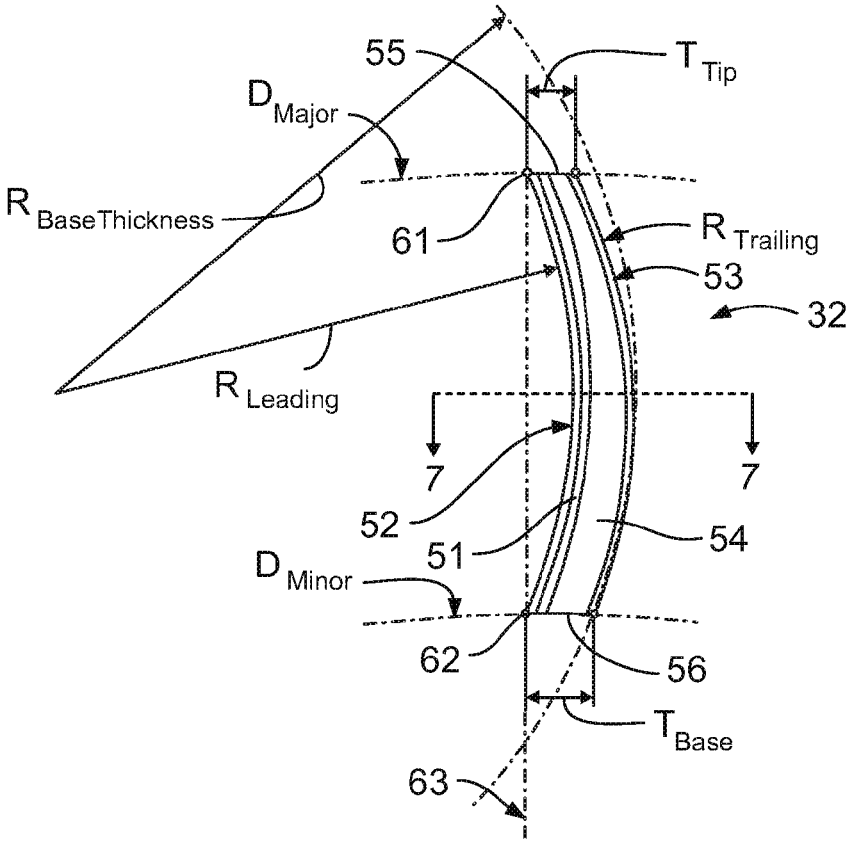
FIG. 6 is a side view of a disclosed impeller vane made in accordance with this disclosure.
Figure 7:
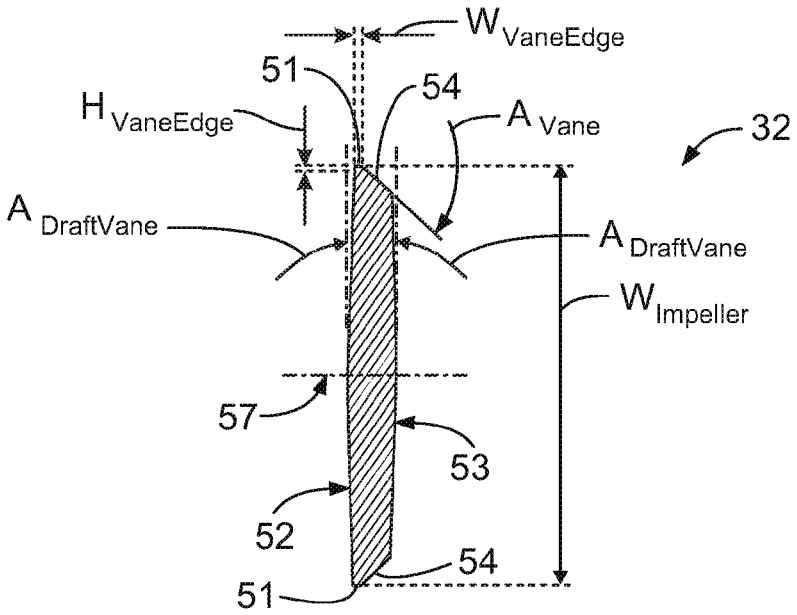
FIG. 7 is a sectional view taken along line 7-7 of FIG. 6.

Turning to FIGS. 6-7, a side view of an impeller vane 32 is disclosed that includes a downstream side 52 and an upstream side 53. The side edges of the vane 32 as shown in FIGS. 6-7 includes a first edge portion 51 along the downstream side 52 and a second beveled portion 54 along the upstream side 53 of the vane 32. This reduction in the width of the vane edges 51, 54 as shown in FIG. 7 and provided by the beveled portions 54 prevents a reduction in blower maximum air flow. As a result, the tapered vane edges 51, 54 reduce turbulence, air velocity loss and heat generation.

Specifically, in the sectional view of the vane 32 of FIG. 7, the first edge portion 51 has a constant width of $W_{VaneEdge}$ while the second beveled portion 54 is tapered slightly as it extends laterally outward as indicated by the draft angles $A_{DraftVane}$ shown along the downstream side 52 and upstream side 53 of the vane 32. Further, the angle of the beveled edge portion 54 is shown as $A_{Vane}$.

FIGS. 6 and 7 also define a number of variables that may be used for optimization, which will be defined below. Turning first to FIG. 6, $D_{Major}$ is the maximum diameter hub 29 at the distal ends 55 of the vanes 32 while $D_{Minor}$ is the diameter of the outer periphery 31 of the main body 33 of the hub 29 or the diameter of the hub 29 where the vanes 32 are connected to the hub 29. $T_{Tip}$ is the thickness of the vane 32 at the tip or distal end 55 of the vane 32 while $T_{Base}$ is the thickness of the vane 32 at its base or where the vane 32 is connected to the outer periphery 31 of the main body 33 of the hub 29. $R_{BaseThickness}$ is the radius of the curvature of the vanes 32 at the base of the vanes 32 or where the vanes 32 are connected to the outer periphery 31 of the main body 33 of the hub 29. In contrast $R_{Leading}$ is the radius of the vanes 32 along their downstream sides 52 and $R_{Trailing}$ is the curvature of the vanes 32 near their respective distal ends 55. The reader will note that because of the tapering of the vanes 32 as they extend from their bases 56 to their distal ends 55, $T_{Base}$ is greater than $T_{Tip}$ and $R_{BaseThickness}$ is greater than $R_{Trailing}$. The leading edges 61, 62 of each vane 32 is disposed along a radial line 63 from the impeller 28 axis of rotation 64 (FIGS. 8-9).

Turning to FIG. 7, $W_{VaneEdge}$ is the thickness of the first portions 51 of both side edges of the vanes 32 and $H_{VaneEdge}$ is the lateral length or thickness of the first portions 51 as shown in FIG. 7. $A_{Vane}$ is the angle of the beveled edge portion 54 and $A_{DraftVane}$ is the draft angle or taper angle of the downstream and upstream sides 52, 53 of the vanes as they extend from their respective centerlines 57 to their respective side edges 51, 54. In the embodiment shown in FIG. 7, $A_{DraftVane}$ is the same for both the downstream and upstream sides 52, 53, but the draft angles may differ from front (downstream) to back (upstream) of the vanes 32. $W_{Impeller}$ is the width of the vanes 32 and therefore the width of the impeller 28.

Figure 8:
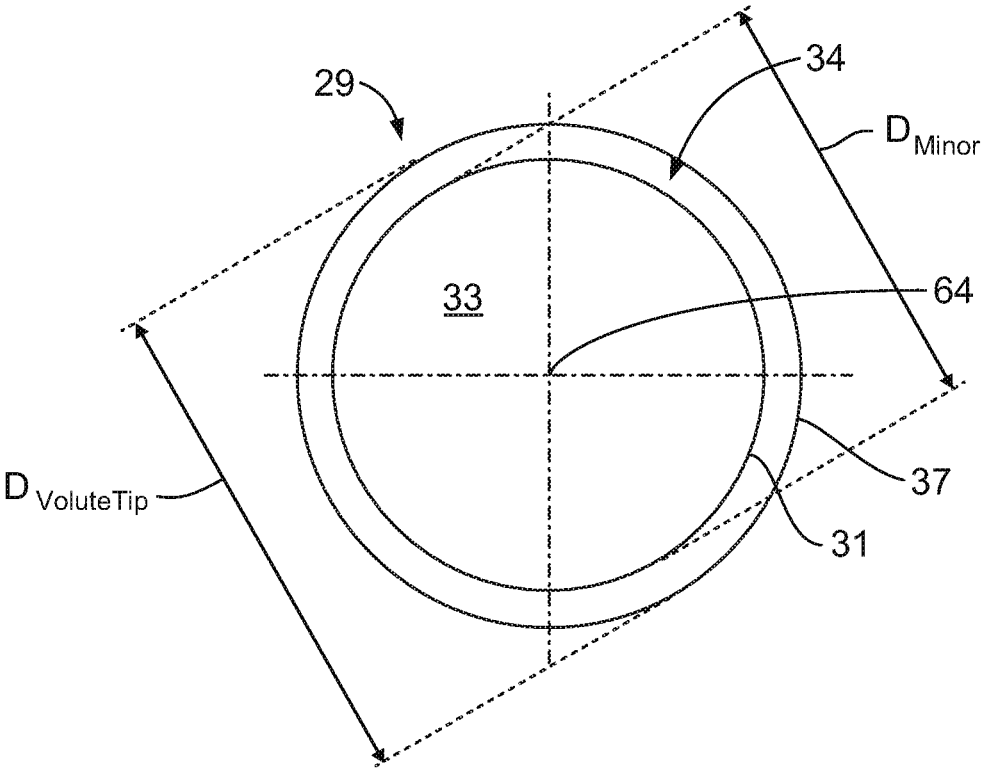
FIG. 8 is a plan view of a disclosed hub made in accordance with this disclosure.
Figure 9:
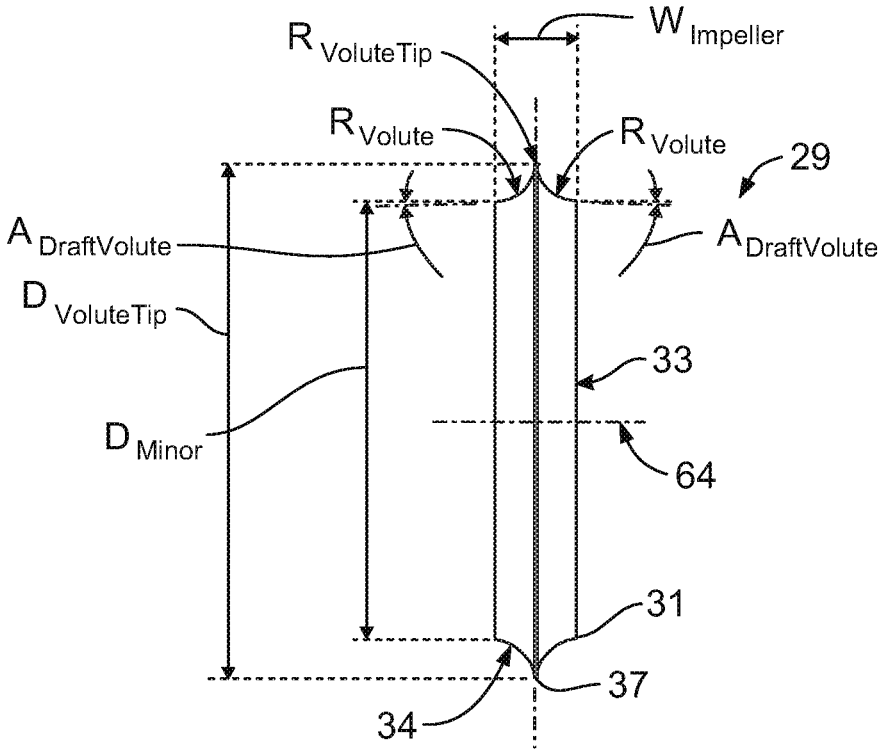
FIG. 9 is an end view of the hub shown in FIG. 8.
Figure 10:
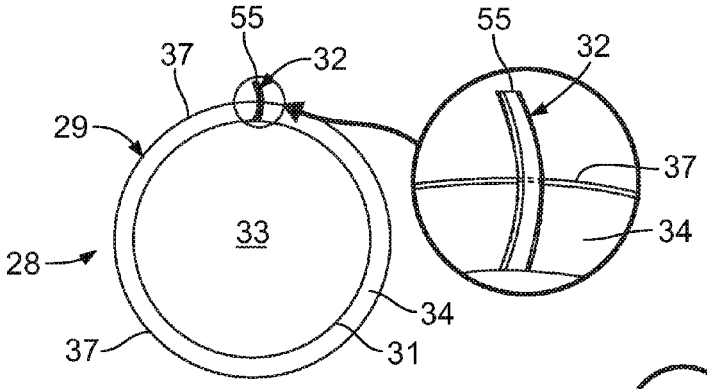
FIG. 10 is a plan view of a disclosed hub and one vane and an enlarged view of the vane and partial enlarged view of the volute and main body of the hub.
Figure 11:
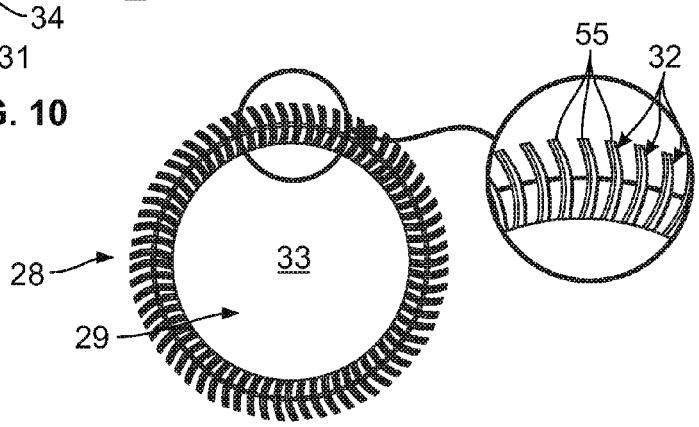
FIG. 11 is a plan view of a disclosed impeller or hub with vanes and an enlarged view of nine vanes and partial enlarged views of the volute and main body of the hub.
Figure 12:
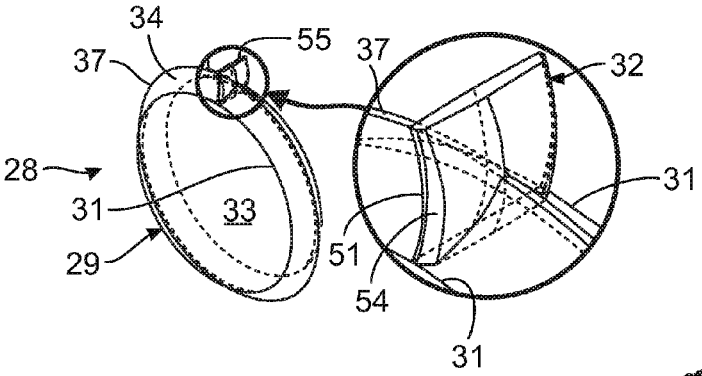
FIG. 12 is a rear perspective view of a disclosed hub and one vane and an enlarged view of the vane and partial enlarged view of the volute and main body of the hub.
Figure 13:
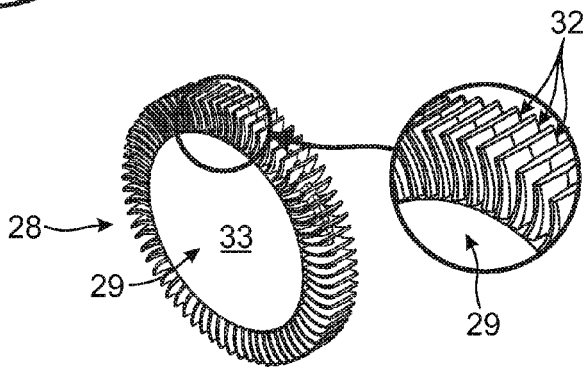
FIG. 13 is a rear perspective view of impeller or hub of FIG. 12 with vanes and an enlarged view of eleven vanes and partial enlarged view of the volute and main body of the hub.

Additional variables and improvements are illustrated in FIGS. 8-9. Turning to FIG. 8, $D_{Minor}$ is the diameter of the main body 33 the hub 29 while $D_{VoluteTip}$ is the diameter of the hub 29 at the volute tip 37. Turning to FIG. 9, the volute tip 37 has a radius $R_{VoluteTip}$ while the curvature or concave slope of the volute 34 is defined by the radius $R_{Volute}$. The volute 34 also has a draft angle $A_{DraftVolute}$ on both sides as shown in FIG. 9. As shown in FIG. 9, the volute 34 extends radially outward from the outer periphery 31 of the hub 29 at an angle that is less than perpendicular due to the draft angle $A_{DraftVolute}$.

The draft angles $A_{DraftVolute}$ (FIG. 9) and $A_{DraftVane}$ (FIG. 7) may range from less than 1° to greater than 3°, with a typical value being about 2°. Further, the angle of the beveled portion 54 of the side edge of the vane 32 or $A_{Vane}$ (FIG. 7) may vary widely, but typically will range from about 30° to about 60°, with a typical value being about 40°. $A_{Vane}$ may be greater than about 40°, which may decrease exhaust temperatures and maximum blower duty. $A_{Vane}$ may also be less than 40°, which can increase maximum blower duties and increase exhaust temperatures.

Plan and perspective views of the impeller 28 are provided in FIGS. 10-13. The impeller 28 includes the hub 29 having the main body 33 with the outer periphery 31, the tapered volute 34 with a volute tip 37. In one embodiment, 69 vanes may be connected to the volute 34 around the outer periphery 31 of the main body 33 of the hub 29. Typically, conventional regenerative blowers will have fewer vanes, such as 44. Thus, the increased number of vanes 32 versus the number of prior art vanes 32*a* of prior art blowers 20*a* can be at as high as 57% or more. The increased number of vanes in conjunction with the improved vane 32 and volute 34 design features helps to increase output flows and output vacuums or pressures.

Figure 14:
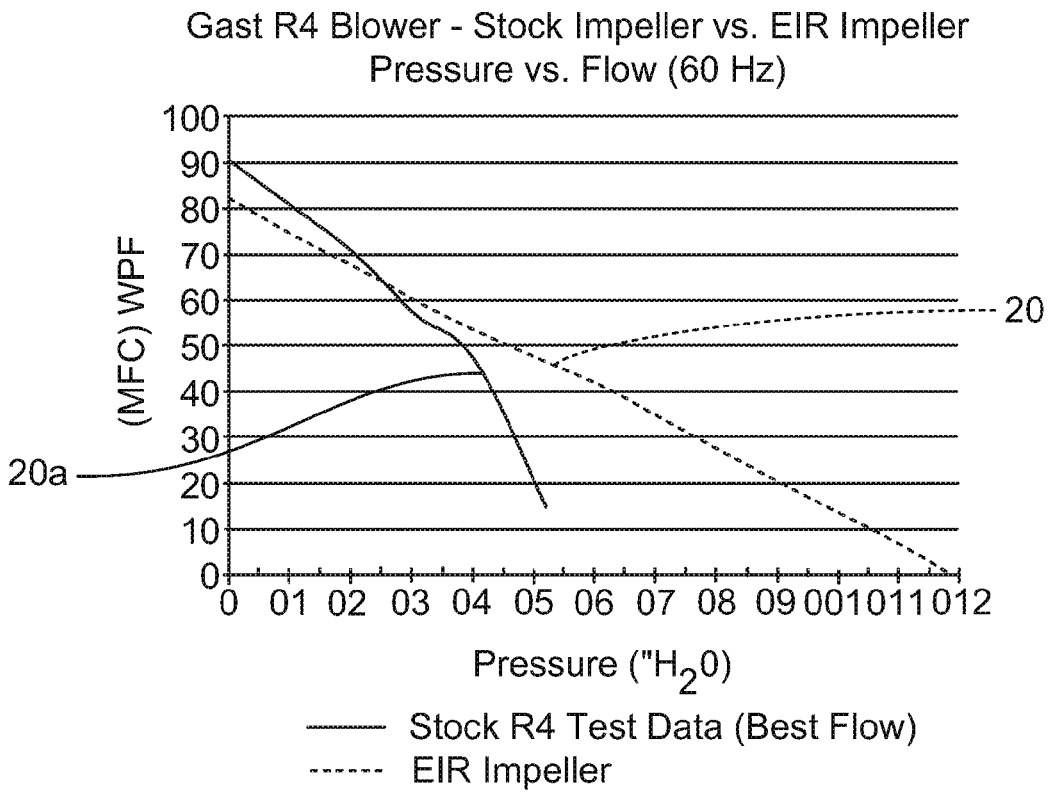
FIG. 14 illustrates, graphically, the improved output pressure of the regenerative blower versus the prior art regenerative blower.
Figure 15:
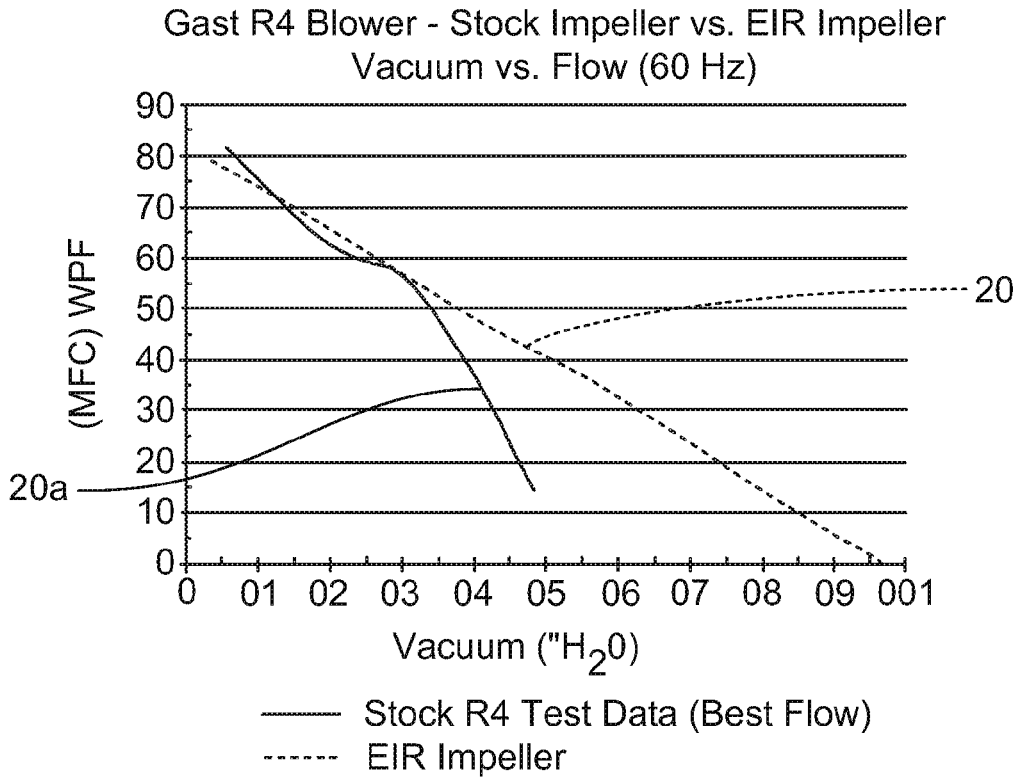
FIG. 15 illustrates, graphically, the improved vacuum generated by the disclosed regenerative blower versus the prior art regenerative blower.

A comparison of the disclosed regenerative blower 20 and a prior art regenerative blower 20*a* is illustrated graphically in FIGS. 14 and 15. FIG. 14 illustrates the improved output pressure of the regenerative blower 20 versus the prior art regenerative blower 20*a* and FIG. 16 illustrates the improved vacuum generated by the disclosed regenerative blower 20 versus the prior art regenerative blower 20*a*.

Figure 16:
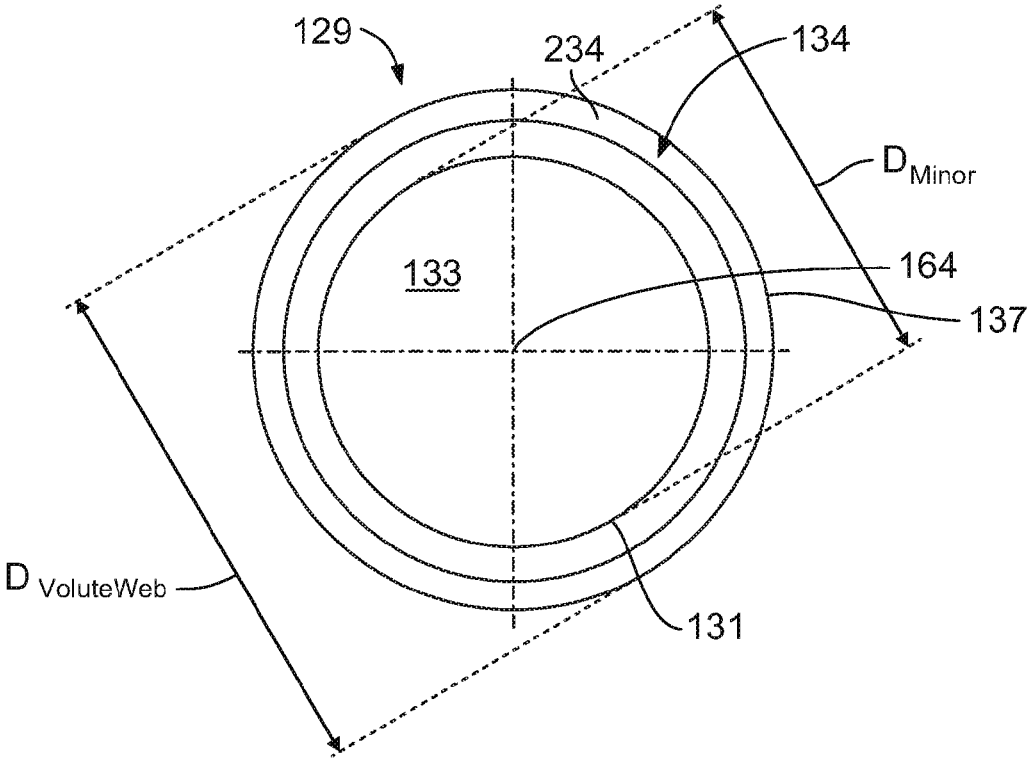
FIG. 16 is a plan view of another disclosed hub made in accordance with this disclosure.
Figure 17:
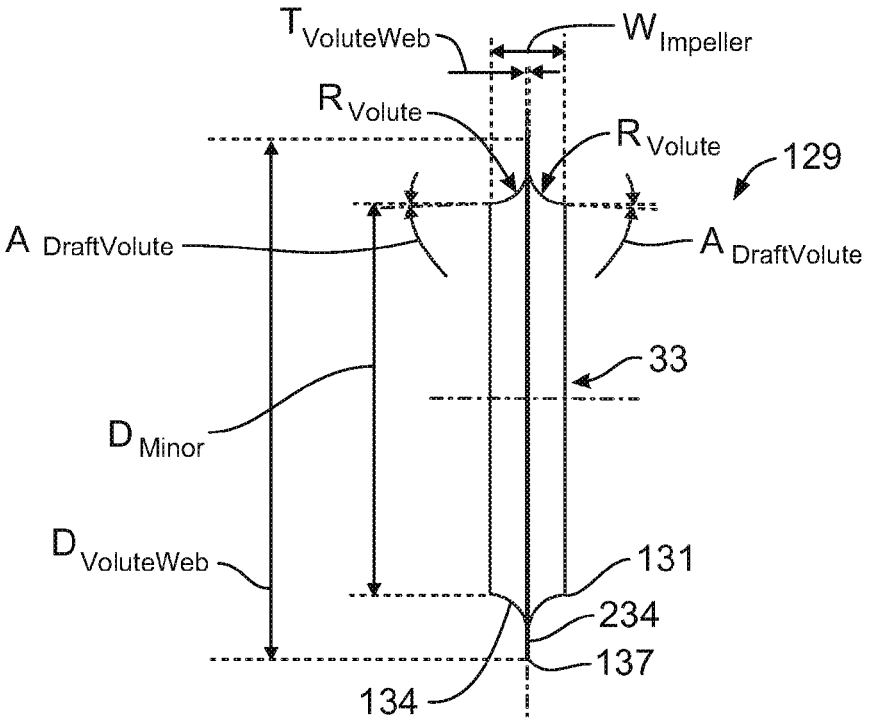
FIG. 17 is an end view of the hub shown in FIG. 16.
Figure 18:
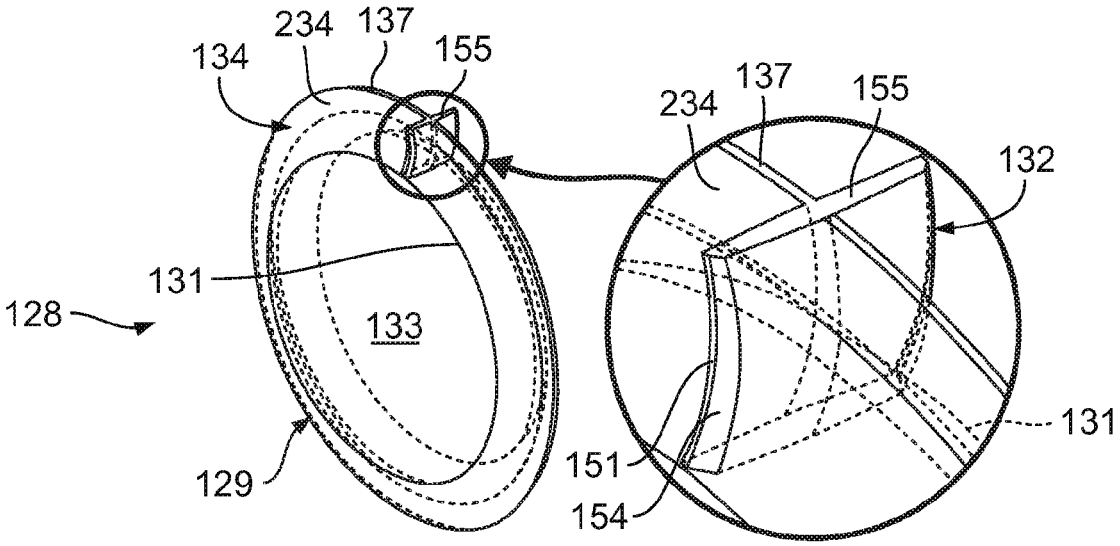
FIG. 18 is a rear perspective view of another disclosed hub and one vane and an enlarged view of the vane and partial enlarged view of the volute and main body of the hub.
Figure 19:
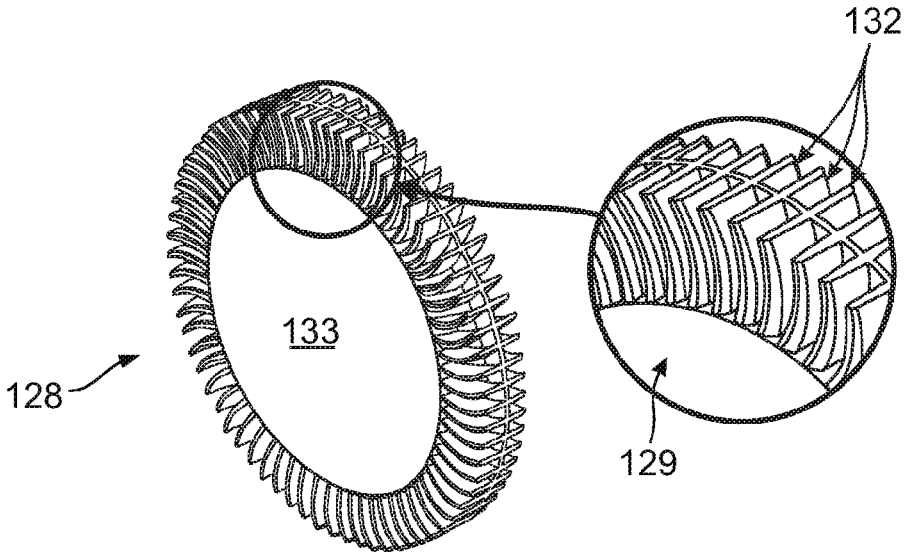
FIG. 19 is a rear perspective view of the impeller or hub of FIG. 18 with vanes and an enlarged view of eleven vanes and partial enlarged view of the volute and main body of the hub.

FIGS. 16-18 illustrate an impeller 128 and hub 129 wherein the volute 134 features a tip 137 disposed at the distal end of a planar web 237 that extends to the distal ends 155 of the vanes 132. Like or similar parts described above are referenced by the same numerals preceded by a one (1), i.e., the volute 34 of FIGS. 1-13 and the volute 134 of FIGS. 16-19. The remaining details will not be repeated here.

INDUSTRIAL APPLICABILITY

Improved impeller and vane designs are disclosed for regenerative blowers. The improved vane designs may include any one or more of the following: an increased number of vanes (69 v. 44); a curvature of the vanes in the forward or downstream direction ($R_{BaseThickness}$, $R_{Leading}$, $R_{Trailing}$); dual portion side edges of the vanes that include a first portion that is a square edge ($W_{VaneEdge}$) and a second portion that is a beveled edge ($A_{Vane}$); draft angles on the downstream and upstream sides of the vanes ($A_{DraftVane}$); and a tapering of the vanes from the bases to the tips of the vanes ($R_{BaseThickness}>R_{Trailing}$, $T_{Base}>T_{Tip}$). The disclosed improved volute or tapered outer periphery of the hub includes steeper curved side walls of the volute ($R_{Volute}$) and a thinner or sharper volute tip ($R_{VoluteTip}$). The volute may also include a draft angle at the outer periphery of the main body of the hub $A_{Draftvolute}$. Various combinations of these design features can be used to more efficiently expel the incoming fluid or gas in a radially outward direction. Specifically, because gas may be accelerated radially outward from either side of the impeller, the disclosed volute is designed so that the air from either side of the impeller is accelerated radially outward at shallow angles that approach a tangential relationship, thereby creating less turbulence and lower exhaust temperatures. The improved impeller and vane design may be incorporated into new regenerative blowers or retrofitted into existing regenerative blowers.

What is claimed is:

1. A regenerative blower comprising:

a casing comprising an inlet, an outlet, the casing defining a chamber;

an impeller rotatably received in the chamber, the impeller comprising a hub having an axis of rotation about which the impeller rotates;

the hub of the impeller comprising a main body and a volute that extends around the main body of the hub, the volute of the hub having a wide base that extends to a volute tip, a plurality of vanes spaced apart along and intersecting the volute, each vane having a base coupled to main body of the hub and a distal end extending radially away from the hub, the distal ends of the vanes being thinner than the bases of the vanes;

each vane having a downstream side and an upstream side, the downstream side being concave, the upstream side being convex, each vane including a pair of side edges that connect the downstream side of the vane to the upstream side of the vane, the side edges each comprising a first portion disposed along the downstream side of the vane that are substantially perpendicular to the downstream side of the vane and a second portion that are beveled inwardly towards the volute as the side edges extend from the first portions to the upstream side of the vane; and the vanes have a thickness at the base of volute $T_{Base}$ defined by the relationship $(D_{Major}-D_{Minor})/(4\times\pi)$ where $D_{Major}$ is the diameter of the impeller at the distal ends of the vanes and $D_{Minor}$ is the diameter of the main body of the hub.

2. The blower of claim 1 wherein each vane has a base coupled to the main body of the hub, a leading edge of the base of the vane that faces downstream, and a leading edge of the distal end of the vane that faces downstream, the leading edge of the distal end of each vane and its respective leading edge of the base and the axis of rotation are at least substantially collinear.

3. The blower of claim 1 wherein one or more downstream side edges of each vane comprises one continuous smooth concave curvature.

4. The blower of claim 1 wherein one or more upstream side edges of each vane comprises of one continuous smooth convex curvature.

5. The blower of claim 1 wherein one or more downstream side edges of each vane comprises a plurality of segments that approximate a continuous smooth concave curvature.

6. The blower of claim 1 wherein one or more upstream side edges of each vane comprises a plurality of segments to approximate one continuous smooth convex curvature.

7. The blower of claim 1 wherein one or more downstream side edges of each vane comprises a combination of at least one curve and at least one segment to approximate one continuous smooth concave curvature.

8. The blower of claim 1 wherein one or more upstream side edges of each vane comprises a combination at least one curve and at least one segment to approximate one continuous smooth convex curvature.

9. The blower of claim 1 wherein the distal ends of the vanes are tapered.

10. The blower of claim 1 wherein the vanes have a thickness $T_{Tip}$ at the distal ends of vanes defined by the relationship $T_{Base}\times X_1$ where $X_1$ ranges from about 0.65 to about 0.75.

11. The blower of claim 1 wherein the number of vanes $N_{Vanes}$ is defined by the relationship $(D_{Minor}\times\pi)/(T_{Base}+T_{Tip})$, wherein $T_{Tip}$ is the thickness of the vanes at the distal ends of the vane and is defined by the relationship $T_{Base}\times X_1$, where $X_1$ ranges from about 0.65 to about 0.75.

12. The blower of claim 1 wherein the vanes have a concave leading radius $R_{Leading}$ defined by the relationship $[(D_{Major}^2+D_{Minor}^2)/(N_{Vanes}]^{1/2}$, wherein $N_{Vanes}$ is the number of vanes.

13. The blower of claim 12 wherein the vanes have a radius of curvature at the base of the vanes $R_{BaseThickness}$, wherein $R_{BaseThickness}$ is geometrically defined by a center point that is coincident with a center point of $R_{Leading}$ and a vane trailing point on $D_{Minor}$ at $T_{Base}$.

14. The blower of claim 13 wherein the vanes have a convex trailing radius $R_{Trailing}$, wherein the vanes have a thickness $T_{Tip}$ at the distal ends of the vanes, and wherein $R_{Trailing}$ is geometrically defined by the vane trailing point on $D_{Minor}$ at $T_{Base}$, a vane trailing point on $D_{Major}$ at $T_{Tip}$, and its a tangency of $R_{Trailing}$ to $R_{BaseThickness}$.

15. The blower of claim 1 wherein the first portions of the side edges of the vanes have a width $W_{VaneEdge}$ defined by the relationship $(D_{Major}-D_{Minor})\times X_2$, wherein $X_2$ ranges from about 0.01 to about 0.015.

16. The blower of claim 15 wherein the first portions of the side edges of the vanes have a thickness $H_{VaneEdge}$ defined by the relationship $W_{VaneEdge}/Y$, wherein Y ranges from about 1.5 to about 3.

17. The blower of claim 1 wherein the volute comprises opposing side walls that are tapered between the volute base and the volute tip.

18. The blower of claim 1 wherein the volute comprises opposing side walls that are tapered between the volute base and the volute tip that may or may not include a radially outwardly extending web.

19. The blower of claim 1 wherein the volute comprises opposing side walls that are concave as they extend between the volute base and a volute tip.

20. The blower of claim 1 wherein the volute comprises opposing side walls that are concave as they extend between the volute base and the volute tip that may or may not include a radially outwardly extending web.

21. The blower of claim 1 wherein the volute tip has a radius $R_{VoluteTip}$ defined by the relationship $(D_{Major}-D_{Minor})\times X_2$ where $X_2$ ranges from about 0.01 to about 0.015 inches.

22. The blower of claim 1 wherein the impeller has a thickness $W_{Impeller}$ at the vanes defined by the relationship $(D_{Major}-D_{Minor})/2)2\times X_3$, wherein $X_3$ ranges from about 1.0 to 1.25.

23. The blower of claim 1 wherein the tapered outermost periphery of the hub has a cross-sectional diameter $D_{VoluteTip}$ defined by the relationship $(D_{Major}+D_{Minor})/2+(2\times R_{VoluteTip})$, wherein $R_{VoluteTip}$ is the radius of the volute tip.

24. The blower of claim 1 wherein the outermost periphery of the hub has a cross-sectional diameter $D_{VoluteWeb}$, which is greater than $D_{Minor}$ and less than or equal to $D_{Major}$.

25. An impeller comprising:

a hub having a main body and an axis of rotation about which the impeller rotates;

the hub also including a volute extending around the main body of the hub, the volute having a wide base that extends to a volute tip, a plurality of vanes spaced apart along the volute and intersecting the volute, each vane having a base coupled to the main body of the hub and a distal end extending radially away from the hub;

each vane having a downstream side and an upstream side, the downstream side being concave, the upstream side being convex, the vanes have a thickness at the base of volute $T_{Base}$ defined by the relationship $(D_{Major}-D_{Minor})/(4\times\pi)$ where $D_{Major}$ is the diameter of the impeller at the distal ends of the vanes and $D_{Minor}$ is the diameter of the main body of the hub, and wherein the vanes have a thickness $T_{Tip}$ at the distal ends of vanes defined by the relationship $T_{Base}\times X_1$ where $X_1$ ranges from about 0.65 to about 0.75.

* * * * *